United States Patent [19]

Johnson et al.

[11] 4,128,452

[45] Dec. 5, 1978

[54] APPARATUS FOR SEPARATING ADHESIVELY CONNECTED MATERIAL

[76] Inventors: Herbert E. Johnson, 1023 Phelps Ave., San Jose, Calif. 95117; William W. Richards, 984 Corbett Ave., San Francisco, Calif. 94131

[21] Appl. No.: 820,513

[22] Filed: Aug. 1, 1977

[51] Int. Cl.[2] ..... B32B 31/00; B25F 3/00; B26B 3/06

[52] U.S. Cl. ..... 156/584; 30/123.3; 30/151

[58] Field of Search ..... 156/584, 344; 30/123.3, 30/151, 164, 162; 224/2 D

[56] References Cited

U.S. PATENT DOCUMENTS

| | | | |
|---|---|---|---|
| 3,040,802 | 6/1962 | Frazer | 156/584 |
| 3,167,861 | 2/1965 | Knebel | 30/162 |
| 3,430,760 | 3/1969 | Ulmer | 224/2 D |
| 3,818,592 | 6/1974 | Himeno | 30/151 |

*Primary Examiner*—Douglas J. Drummond
*Attorney, Agent, or Firm*—Townsend and Townsend

[57] ABSTRACT

An apparatus for separating adhesively connected material, such as pressure-sensitive labels. A thin blade having a wedge-shaped periphery is connected to a handle which extends angularly upward from the blade. The blade portion is retained in a sheath having inner surfaces of absorbent material. A lubricating substance, such as a silicone fluid, is evenly distributed throughout the absorbent material of the sheath. When the blade portion is inserted into and withdrawn from the sheath, the lubricant is applied to all surfaces of the blade, permitting nearly frictionless contact between the blade and the material to be separated.

4 Claims, 4 Drawing Figures

APPARATUS FOR SEPARATING ADHESIVELY CONNECTED MATERIAL

BACKGROUND OF THE INVENTION

The present invention relates to an apparatus for separating material that is adhesively connected, and is particularly directed to solving the problem of removing pressure-sensitive price labels from many types of containers. In many industries, such as the retail food industry, it is the accepted practice to remove old price labels from containers when there are price changes. Such practice has been instituted in the interest of public relations, since it has been found that shoppers disapprove of the practice of applying new price labels directly over the old price labels. Price changes can be quite frequent, and especially where there are a vast number of different items, can necessitate the full-time services of several employees. Furthermore, because these labels must be applied securely to prevent easy removal by the shopper, their removal can be quite time-consuming.

Various common implements have been utilized to remove pressure-sensitive price labels. These items include kitchen knives, razor blades, and even fingernails. The only implement known to applicant which is specifically directed to removing price labels is an item commercially available under the trademark CONDE-PEEL. This implement has a blade contained in a sheath. Only a portion of the periphery of the blade consists of cutting edges. This implement has serious limitations in that the cutting edges are placed so as to permit only sideways movement of the blade. Furthermore, the sheath which retains the blade possesses only a small strip of absorbent material. Consequently, the sheath and the absorbent material provide for application of a lubricant only on the upper surface of the blade. None of the prior art devices are capable of rapidly removing price labels without becoming gummed up over a period of extended use and without mutilating either the label or the container.

SUMMARY OF THE INVENTION

The present invention provides an apparatus for rapidly removing labels or other adhesively connected material from containers and the like. The apparatus contains a flat, planar portion with upper and lower parallel surfaces and with a surface inclined from the upper surface to the lower surface to provide cutting edges about the periphery. In the preferred embodiment, the blade is stainless steel and has a flat frontal portion manufactured in a rectangular shape so as to present cutting edges in three directions. The rear portion of this blade is bent upwardly, preferably in the form of a compound bend, so as to provide a means for attaching the handle.

A lubricating substance, such as a silicone fluid, is applied to all surfaces of the blade. One such silicone fluid is manufactured by Union Carbide and is commercially available under the trademark "L45". It is the lubricating substance which permits the blade to pass freely between the label and the surface to which it is adhered. The lubricating substance also prevents the adhesively connected material from sticking to the blade portion as the cutting edges of the blade cut through the adhesive. In the preferred method of applying the lubricating substance to the blade, a sheath containing absorbent material is utilized. The lubricating substance is evenly distributed throughout the absorbent material of the sheath. In this manner a minute amount of lubricating substance is reapplied to the blade each time it is inserted into and withdrawn from the sheath.

In the preferred mode of operation to remove price labels, the apparatus is withdrawn from the sheath so as to apply a minute portion of lubricating substance to the blade, grasped in the hand with the forefinger resting on the rear portion of the blade connecting the blade to the handle, and pushed forward over the surface to which the label is adhered. Normally, one smooth forward motion of the blade is sufficient to remove the label. This is especially true when the label is applied to a flat surface. In cases where the label is applied to other than flat surfaces, several forward thrusts of the blade may be required to remove the label. The blade portion of the apparatus possesses sufficient flexibility so as to permit the removal of labels from other than flat surfaces.

The present invention removes labels with surprising ease. Not only are the prior art devices time-consuming, they often remove only portions of a label and often damage the container to which the label is adhered. The present invention, in contrast, removes labels quickly and without mutilating either the label or the container.

The novel features which are believed to be characteristic of the invention, together with further objects and advantages thereof, will be better understood from the following description considered in connection with the accompanying drawings in which preferred embodiments of the invention are illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
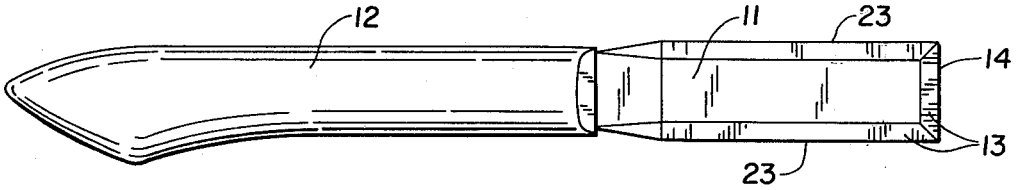
FIG. 1 is a top view of the apparatus and illustrates the rectangular shape of the frontal portion of the blade and the wedge-shaped periphery.

The apparatus in the present invention is illustrated in FIG. 1. The apparatus includes a thin blade 11 having a frontal portion with upper and lower parallel surfaces and a handle 12 for gripping. The blade has surfaces 13 angularly inclined from the upper surface to the lower surface to provide for cutting edges. In the preferred embodiment, the blade has a rectangularly shaped frontal portion having a flat frontal edge 14 and side edges 23. The periphery of the frontal portion of the blade exhibits a wedge or chisel shape 13. The preferred material for the blade is stainelss steel since such material is flexible and not susceptible to corrosion. However, other material such as a suitably durable plastic would function as well.

Figure 2:
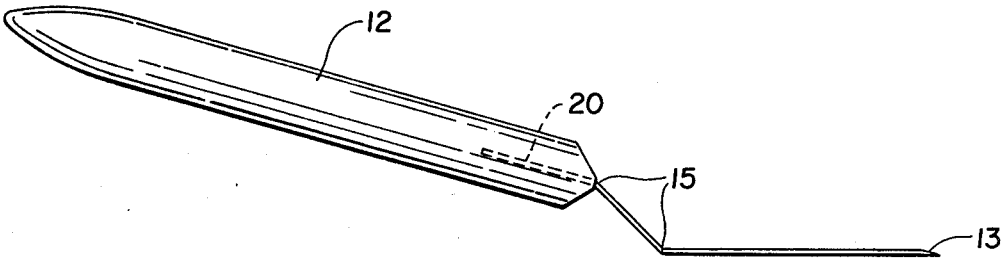
FIG. 2 is a side view of the apparatus which shows the blade and handle portions, and specifically the compound bend at the rear portion of the blade.

The blade 11 is connected to the handle 12 by means of a compound bend 15 in the rear portion of the blade as shown in FIG. 2. The blade can be attached to the handle by forcibly fitting the rear portion 20 of the blade into a slot of the handle 12.

Figure 3:
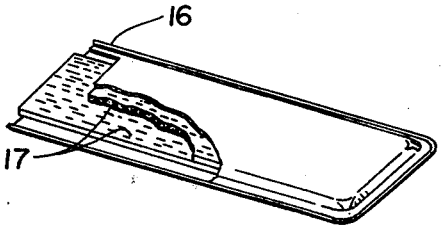
FIG. 3 is a cutaway view of the sheath, showing the absorbent material which lines the sheath and which absorbs the lubricating substance.

The preferred method for the application of the lubricant to the blade is by means of a sheath 16 as displayed in FIG. 3. The sheath contains absorbent material 17 on both the upper and lower inside surfaces. The lubricant can be applied to the absorbent material by merely dropping a few drops of the lubricant into the inside of the sheath. In an alternative method, the absorbent material can be soaked in the lubricant prior to its insertion into the sheath. The sheath 16 serves an additional function of protecting the sharp periphery of the blade. While the sheath 16 with its absorbent inner surfaces 17 is the preferred method for the application of the lubricant to the blade, alternative means for applying a lubricant are available. For example, the lubricant could be applied to the blade by spraying thereon or by dipping the blade into a lubricant in liquid form. The preferred type of lubricant is a silicone fluid. This fluid, such as a product commercially available under the Union Carbide trademark "L45", possesses the necessary qualities of being odorless, water repellant, of low surface tension, and of excellent lubricity. Union Carbide L45 silicone fluids are dimethylpolysiloxanes and are nontoxic, which makes them suitable when the apparatus is used to remove labels from food containers.

Figure 4:
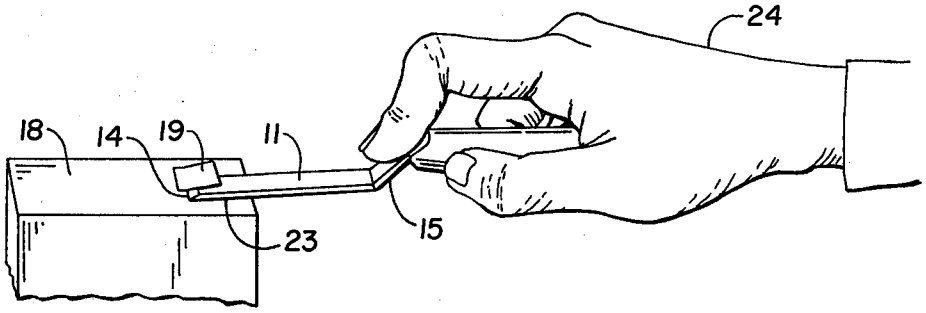
FIG. 4 is a perspective view showing the preferred mode of operation of the apparatus, and specifically illustrating the position of the forefinger in order to guide the apparatus forward.

The preferred mode of operation of the invention is illustrated in FIG. 4 in which a hand 24 is shown. The apparatus is gripped by the handle with the forefinger placed on the compound bend portion 15 of the blade 11. The placement of the finger on the compound bend portion 15 allows one to apply an even downward pressure so that the entire lower surface of the blade remains in contact with the surface to which the label is adhered. The lower flat surface of the blade 11 is made to coincide with the surface 18 to which the label 19 is adhered. The blade is pushed forward with the leading edge 14 cutting through the adhesive. While this is the preferred method of operation, in situations where this method is not practical, the side cutting edges 23 may be used to move the blade in a lateral movement. The lubricant reduces friction between the label 19, the blade 11 and the adhering surface 18. Thus, when the label is ultimately removed it is not adhered to the upper surface of the blade 11. While preferred embodiments of the present invention have been illustrated in detail, it is apparent that modifications and adaptions of those embodiments will occur to those skilled in the art. However, it is to be expressly understood that such modifications and adaptations are within the sphere and scope of the present invention as set forth in the following claims.

What is claimed is:

1. An apparatus for separating adhesively connected material which comprises:

(a) a blade having a generally rectangular frontal portion with an upper surface, a planar lower surface and a surface angularly inclined from said upper surface to said lower surface, the intersection of said lower surface and said angularly inclined surface defining a straight leading cutting edge and side cutting edges, said blade having a rear portion upwardly inclined;

(b) a handle means for gripping connected to said rear portion of said, blade;

(c) a sheath for retaining said blade, said sheath having inner walls of absorbent material; and (d) a lubricant generally equally distributed throughout the inner absorbent walls of said sheath, whereby said lubricant is applied to all of said surfaces of said blade when said blade is inserted into and withdrawn from said sheath.

2. An apparatus as recited in claim 1, in which the blade is stainless steel.

3. An apparatus as recited in claim 1, in which the lubricant is silicone fluid.

4. An apparatus as recited in claim 3, in which the silicone fluid is a dimethylpolysiloxane.

* * * * *